United States Patent [19]

Uchikawa

[11] Patent Number: 4,854,288

[45] Date of Patent: Aug. 8, 1989

[54] AIR-FUEL RATIO CONTROL APPARATUS IN INTERNAL COMBUSTION ENGINE

[75] Inventor: Akira Uchikawa, Isesaki, Japan

[73] Assignee: Japan Electronic Control Systems Co., Gunma, Japan

[21] Appl. No.: 179,535

[22] Filed: Apr. 8, 1988

[30] Foreign Application Priority Data

Apr. 14, 1987 [JP] Japan ..... 62-89851

[51] Int. Cl.[4] ..... F02M 51/00

[52] U.S. Cl. ..... 123/489; 123/440; 204/406; 60/274

[58] Field of Search ..... 123/489, 440, 434; 204/406, 1 T, 408, 412; 60/274

[56] References Cited

U.S. PATENT DOCUMENTS

| | | | |
|---|---|---|---|
| 4,615,319 | 10/1986 | Tomisawa | 123/489 |
| 4,655,188 | 4/1987 | Tomisawa et al. | 123/489 |
| 4,707,984 | 11/1987 | Katsuno et al. | 123/489 |
| 4,729,359 | 3/1988 | Tomisawa et al. | 123/440 |
| 4,745,741 | 5/1988 | Masui et al. | 123/489 |
| 4,747,265 | 5/1988 | Nagai et al. | 123/489 |
| 4,750,328 | 6/1988 | Sawada | 123/489 |
| 4,763,627 | 8/1988 | Tomisawa | 123/440 |
| 4,766,870 | 8/1988 | Nakajima et al. | 123/489 |
| 4,773,376 | 9/1988 | Uchikawa et al. | 123/489 |

FOREIGN PATENT DOCUMENTS

| | | | |
|---|---|---|---|
| 51-106826 | 9/1976 | Japan | 123/489 |
| 58-013130 | 1/1983 | Japan | 123/489 |
| 58-027819 | 2/1983 | Japan | 123/489 |
| 59-010764 | 1/1984 | Japan | 123/489 |
| 59-203828 | 11/1984 | Japan | 123/489 |
| 59-203829 | 11/1984 | Japan | 123/489 |
| 59-211738 | 11/1984 | Japan | 123/489 |
| 59-211742 | 11/1984 | Japan | 123/489 |
| 60-090944 | 5/1985 | Japan | 123/489 |
| 60-093143 | 5/1985 | Japan | 123/489 |
| 2141839 | 11/1986 | United Kingdom | 123/489 |
| 2165063 | 8/1987 | United Kingdom | 123/489 |

*Primary Examiner*—Raymond A. Nelli

*Attorney, Agent, or Firm*—Sandler & Greenblum

[57] ABSTRACT

An air-fuel ratio control apparatus in an internal combustion engine with air-fuel ratio feedback control means comprises first air-fuel ratio sensor which senses the air-fuel ratio of the air-fuel mixture having a first level of the theoretical air-fuel ratio or leaner than the theoretical air-fuel ratio and second air-fuel ratio sensor which senses the air-fuel ratio of the air-fuel mixture having second level of the air-fuel ratio richer than the first air-fuel ratio. In a region where the amount of $NO_x$ generated is small, the first air-fuel feed back control is performed based on the detection by the first air-fuel ratio sensor, while in a region where the amount of $NO_x$ generated is large, the second air-fuel feedback control is performed based on the detection by the second air-fuel ratio sensor, whereby the amount of $NO_x$ is reduced without using an EGR control system.

11 Claims, 5 Drawing Sheets

AIR-FUEL RATIO CONTROL APPARATUS IN INTERNAL COMBUSTION ENGINE

BACKGROUND OF THE INVENTION (1) Field of the Invention

The present invention relates to a control of an air-fuel ratio in an internal combustion engine. More particularly, the present invention relates to a control of an air-fuel ratio for reducing nitrogen oxide (hereinafter referred to as "$NO_x$") in an exhaust gas.

(2) Description of the Related Art

As the conventional apparatus for controlling an air-fuel ratio in an internal combustion engine, there can be mentioned, for example, an apparatus disclosed in Japanese Patent Application Laid-Open Specification No. 203828/84.

According to this technique, the intake air flow quantity Q and engine rotation number N are detected, the basic fuel injection quantity is set based on the detected intake air flow quantity and engine rotation number, and the basic fuel injection quantity is corrected based on the temperature of engine-cooling water and the like factors.

Furthermore, an air-fuel ratio sensor for detecting the air-fuel ratio of an air-fuel mixture supplied to the engine by detecting the oxygen concentration in the exhaust gas is disposed, and under predetermined driving conditions the fuel injection quantity is feedback-controlled based on the detected oxygen concentration so that the air-fuel ratio becomes an aimed value (for example, the theoretical air-fuel ratio). At the time of starting or under high-load conditions, the above-mentioned feedback control is stopped and a feed forward control is performed so that the air-fuel ratio is corrected to a richer value.

Incidentally, in the above-mentioned conventional air-fuel ratio sensor, for example $O_2$ sensor, an oxidation catalyst layer therein has no substantial effect of reducing nitrogen oxides $NO_x$, and therefore, the oxygen concentration in the exhaust gas is detected irrespectively of the concentration of nitrogen oxides $NO_2$. Nitrogen oxides $NO_x$, however, are formed by bonding of nitrogen $N_2$ in the air to oxygen $O_2$ in a high temperature atmosphere.

Namely, $O_2$ should be detected as $O_2$, which has not made any contribution to combustion, for detection of the air-fuel ratio, but this oxygen $O_2$ is not detected by the conventional $O_2$ sensor.

Accordingly, the detection value of the $O_2$ sensor is increased by the amount corresponding to the amount of oxygen which is reacted with nitrogen gas $N_2$ to form $NO_x$, and in the air-fuel ratio region where the detection value of the $O_2$ sensor is inverted, the apparent air-fuel ratio is leaner than the actual air-fuel ratio.

Therefore, if feedback control of the air-fuel ratio is performed according to the detection result based on the air-fuel ratio as a reference in the inversion region of the $O_2$ sensor, the air-fuel ratio is erroneously controlled to a level leaner than the theoretical air-fuel ratio as the target air-fuel ratio, and there is a risk that oxidation reaction of nitrogen gas is advanced and nitrogen oxides $NO_x$ in the exhaust gas are excessive.

Under driving conditions where the $NO_x$ concentration in the exhaust gas is larger, the above-mentioned air fuel control, should employ so-called exhaust gas recycle (EGR) control for recycling a part of the exhaust gas of the engine into a sucked air of the engine to lower the combustion temperature and hence the $NO_x$ concentration. The EGR control system is well-known in the field of automobile engine technique.

In this conventional EGR control system, the structure is complicated because an EGR passage, EGR control valves and other members disposed in the EGR passage are necessary, with the result that the cost is increased. Moreover, the combustion efficiency is reduced by introduction of the exhaust gas into the fresh air to be sucked in the engine and therefore, the fuel consumption is drastically increased.

Accordingly, it is appreciated that the traditional $O_2$ sensor is used only in the condition of small amount of nitrogen oxides $NO_2$ in the exhaust gas since the engine is driven by using the leaner air-fuel mixture to get small fuel consumption.

While another improved $O_2$ sensor is disclosed in the U.S. patent application No. 117,507 by use in which reaction of nitrogen oxides $NO_x$ is further promoted to eliminate the above-mentioned disadvantages of the conventional $O_2$ sensor structure and the concentration of oxygen, exclusive of oxygen gas which has not participated in combustion, for example, oxygen gas in $CO_2$, in a sample gas can be detected more accurately. Therefore it is desirable to use the improved $O_2$ sensor to reduce the amount of nitrogen oxide $NO_x$ in the exhaust gas of the engine when the large amount of nitrogen oxides $NO_x$ is detected.

SUMMARY OF THE INVENTION

An object of the present invention is to solve these problems of the conventional technique.

It is another object of the present invention to provide an air-fuel ratio control apparatus in an internal combustion engine, in which in a region where the amount of $NO_x$ generated is small, the first air-fuel feedback control is performed based on the detection by the conventional air-fuel ratio sensor, whereby the fuel consumption is reduced, while in a region where the amount of $NO_x$ generated is large, the second air-fuel feedback control is performed based on the detection by the improved air-fuel ratio sensor, whereby the amount of $NO_x$ is reduced without using the EGR control system.

According to the present invention, this object can be attained by an air-fuel ratio control apparatus for controlling the air-fuel ratio of an air-fuel mixture in an internal combustion engine, which comprises first air-fuel ratio sensing means for sensing a first level of the air-fuel ratio and outputting a reversed signal when the air-fuel ratio of the air-fuel mixture supplied to the engine is the first level of the theoretical air-fuel ratio or leaner than the theoretical air-fuel ratio, second air-fuel ratio sensing means for sensing a second level of the air-fuel ratio and outputting a reversed signal when the second level of the air-fuel ratio of the air-fuel mixture is richer than the first air-fuel ratio, large $NO_x$ discharge quantity region-detecting means for detecting the driving region where the quantity of nitrogen oxide ($NO_x$) discharged from the engine is large, first air-fuel ratio feedback control means for performing feedback control of the air-fuel ratio to the vicinity of the first level of the air-fuel ratio, where the output level of the first air-fuel ratio sensing means is reversed, based on a signal from said first air-fuel ratio sensing means in at least a part of the region other than the driving region of the large $NO_x$ discharge quantity detected by said detecting means, and second air-fuel ratio feedback control means for performing feedback control of the air-fuel ratio to the vicinity of the second level of the air-fuel ratio, where the output level of the second air-fuel ratio sensing means is reversed, based on a signal from said second air-fuel ratio sensing means in the driving region of the large $NO_x$ discharge quantity detected by said large $NO_x$ discharge quantity region-detecting means.

In accordance with the present invention, in at least a part of the region other than the driving region detected by the larger $NO_x$ quantity region-detecting means, the air-fuel ratio is feedback-controlled to the first air-fuel ratio which is in the vicinity of the theoretical air-fuel ratio or a leaner air-fuel ratio than the theoretical air-fuel ratio, where the output level of the first air-fuel ratio sensing means is reversed, by the first air-fuel ratio feedback control means. As is apparent from the foregoing description, in the driving region of the smaller $NO_x$ discharge quantity, the air-fuel ratio of the mixture is feedback controlled to the leaner level and therefore the discharge quantity of unburnt component such as HC and CO is reduced to improve the fuel consumption efficiency. While in the driving region of the large $NO_x$ discharge quantity detected by the large $NO_x$ discharge quantity region-detecting means, the air-fuel ratio is feedback-controlled to the richer air-fuel ratio than the first air-fuel ratio, where the output level of the second air-fuel ratio sensing means is reversed, by the second air-fuel ratio feedback control means. Since the air-fuel ratio is thus controlled to a richer side, the amount discharged of $NO_x$ is reduced.

A further object of the present invention is to provide an air-fuel ratio sensing means for detecting an oxygen gas concentration in which reaction oxides $NO_x$ is further promoted and the concentration of oxygen, exclusive of oxygen gas which has not participated in combustion, for example, oxygen gas in $CO_2$, in a sample gas can be detected more accurately.

The present invention will now be described in detail with reference to a preferred embodiment illustrated in the accompanying drawings, but the present invention is not limited by this embodiment and the present invention includes changes and modifications within the range of the object and the technical scope of the present invention.

DETAILED DESCRIPTION OF THE PREFERRED EMBODIMENT

Figure 1:
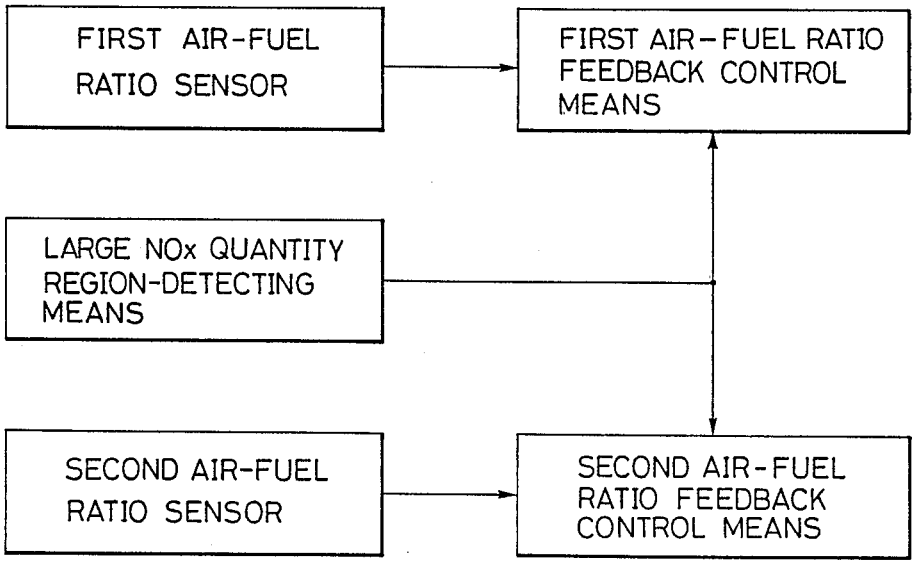
FIG. 1 is a block diagram illustrating a structure of the present invention.

FIG. 1 illustrates a general construction of the present invention and one example of the present invention will now be described with reference to the accompanying drawings.

Figure 2:
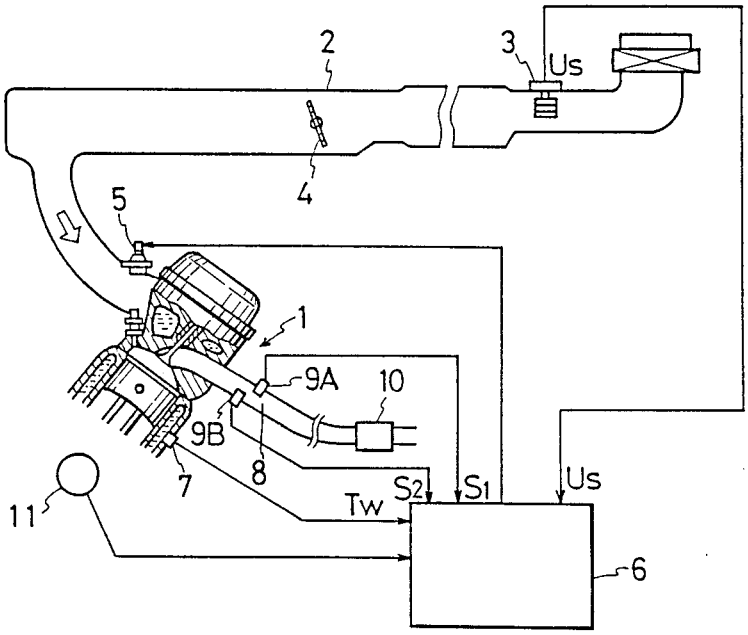
FIG. 2 is a diagram illustrating the entire structure of one example of the present invention.

Referring to FIG. 2 illustrating the structure of this example, an air flow meter 3 for detecting the intake air flow quantity Q and a throttle valve 4 co-operating with an accelerator pedal for controlling the intake air flow quantity are disposed in an intake passage 2 of an engine 1, and electromagnetic fuel injection valves 5 for respective cylinders are arranged in a manifold portion located downstream. Each fuel injection valve 5 is opened and driven by an injection pulse signal from control unit 6 having a micro-computer built therein, and a fuel fed under pressure by a fuel pump not shown and having a pressure controlled to a predetermined level is injected and supplied. Furthermore, a water temperature sensor 7 is arranged to detect the temperature Tw of cooling water in a cooling jacket of the engine. In an exhaust passage 8, there are disposed a first air-fuel ratio sensor 9A having such characteristics that the output level is reversed between low (L) and high (H) levels in response to the oxygen concentration of the exhaust gas at a point where the air-fuel ratio in a sucked air-fuel mixture is the first level of a theoretical air-fuel ratio or leaner than the theoretical air-fuel ratio and a second air-fuel ratio sensor 9B having such characteristics that the output level is reversed between L and H levels at a point where the air-fuel ratio in the sucked air-fuel mixture is richer than the first level of the air-fuel ratio, and downstream of these sensors 9A and 9B, there is disposed a ternary catalyst 10 for purifying the exhaust gas by oxidizing CO and HC in the exhaust gas and reducing $NO_x$ in the exhaust gas. A crank angle sensor 11 is arranged in a distributor not shown and the engine rotation number N is detected by counting crank unit angle signals outputted from the crank angle sensor 11 synchronously with the rotation of the engine for a certain time or by measuring the period of crank standard angle signals.

Figure 3:
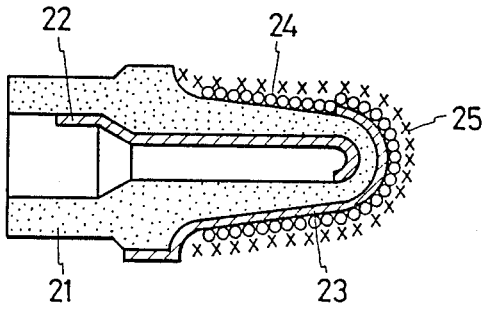
FIG. 3 and 4 are sectional views illustrating main parts of first and second air-fuel ratio sensors used in the above-mentioned example, respectively.

An oxygen gas concentration detecting zone of the first air-fuel ratio sensor 9A has a structure shown in FIG. 3. A whole structure of a typical air-fuel ratio sensor such as the sensor 9A is well-known as is shown in the U.S. patent application No. 117,507.

Electromotive force take-out electrodes 22 and 23 are formed by coating a platinum (Pt) paste on parts of the inner and outer surfaces of a ceramic tube 21 having the top end closed and being composed mainly of zirconium oxide ($ZrO_2$) and calcining the coated ceramic tube 21. The outer electrode is grounded and the inner electrode is connected to the control unit 6 through a lead harness not shown. Platinum is further vacuum-deposited on the outer surface of the ceramic tube 21 to form a platinum catalyst layer 24 and a metal oxide such as magnesium spinel is flame-sprayed on the platinum catalyst layer 24 to form a protecting layer 25 for protecting the platinum catalyst layer 24.

In this structure, an atmospheric air is introduced as a reference gas into an inner cavity of the ceramic tube 21, and the outer side of the ceramic tube 21 is exposed to the exhaust gas passage of the engine and contacted with the exhaust gas of the engine. A voltage corresponding to the ratio between the oxygen concentration in the outer air contacted with the inner surface and the oxygen concentration in the exhaust gas contacted with the outer surface is generated between the electrodes 22 and 23, whereby the oxygen concentration in the exhaust gas is detected.

Incidentally, the platinum catalyst layer 24 promotes oxidation reactions of carbon monoxide CO and hydrocarbons HC with oxygen $O_2$, that is, reactions of $CO+\frac{1}{2}O_2 \rightarrow CO_2$ and $HC+O_2 \rightarrow H_2O+CO_2$, and when combustion is effected with a second air-fuel ratio of the mixture richer than a first air-fuel ratio, for instance, the theoretical air-fuel ratio, remaining low-concentration $O_2$ is effectively reacted with CO or HC by the platinum catalyst layer to reduce the $O_2$ concentration closely to zero, with the result that the $O_2$ concentration ratio between the inner and outer sides of the ceramic tube 21 is increased and a large electromotive force is generated. On the other hand, when combustion is effected with an air-fuel ratio leaner than the first air-fuel ratio which is, for example, the theoretical air-fuel ratio or leaner than the theoretical air-fuel ratio, since $O_2$ is present at a higher concentration and CO and HC are present at lower concentrations in the exhaust gas, even after the reaction of CO and HC with $O_2$, $O_2$ is still left and the $O_2$ concentration ratio between the inner and outer sides of the ceramic tube 21 is small and no substantial voltage is produced.

Figure 5:
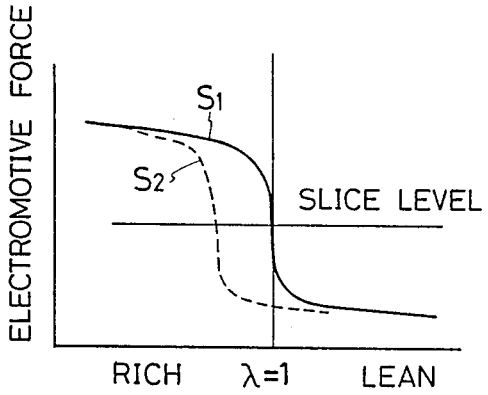
FIG. 5 is a graph illustrating the characteristics of the above-mentioned two air-fuel ratio sensors.

The output (electromotive force) characteristics of the first air-fuel ratio sensor 9A are indicated by solid line S1 in FIG. 5, and as is seen from this solid line S1, the output of the air-fuel ratio sensor 9A is reversed to the H level on the rich side or to the L level on the lean side with the vicinity of the theoretical air-fuel ratio ($\lambda=1$) being as the boundary when the first air-fuel ratio is the theoretical air-fuel ratio.

Figure 4:
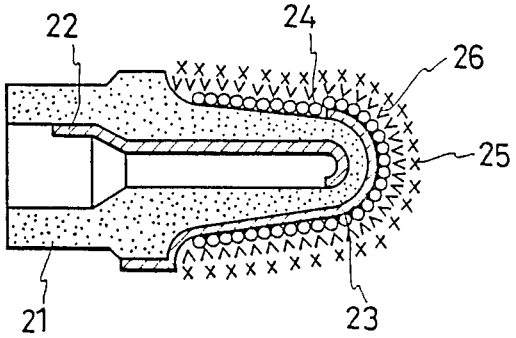

An oxygen gas concentration detecting zone of the second air-fuel ratio sensor 9B is shown in FIG. 4. The basic structure is the same as that of the first air-fuel ratio sensor 9A, but the sensor 9B is different from the sensor 9A in that a rhodium or ruthenium catalyst layer 26 is interposed between the platinum catalyst layer 24 and the protecting layer 25.

Rhodium Rh and ruthenium Ru are generally known as a reducing catalyst for nitrogen oxide $NO_x$.

When $NO_x$ contained in the exhaust gas arrives at the rhodium or ruthenium catalyst layer 26, the rhodium or ruthenium catalyst layer 26 promotes the following reactions of $NO_x$ with CO and HC:

$$NO_x+CO \rightarrow N_2+CO_2$$

$$NO_x+HC \rightarrow N_2+H_2O+CO_2$$

Accordingly, the amounts of unburnt CO and HC which arrived at the platinum catalyst layer 24 located on the inner side and are reacted with $O_2$ are reduced by the reactions in the rhodium or ruthenium catalyst layer 26, and the $O_2$ concentration reacted with the platinum catalyst layer 24 is accordingly increased.

Therefore, the difference between the $O_2$ concentration on the inner side of the ceramic tube 21, which is contacted with the outer air, and the $O_2$ concentration of the exhaust gas side is reduced, and as indicated by dot line S2 in FIG. 5, the electromotive force is reversed and reduced below the slice level on the side richer than such a first air-fuel ratio as the theoretical air-fuel ratio ($\lambda=1$).

The higher is the $NO_x$ concentration in the exhaust gas, the larger become the amounts of unburnt components CO and HC to be reacted with $NO_x$, and the amounts of these components to be reacted with $O_2$ are decreased. Thus, the target air-fuel ratio is detected on the richer side than the first air-fuel ratio sensor.

Figure 6:
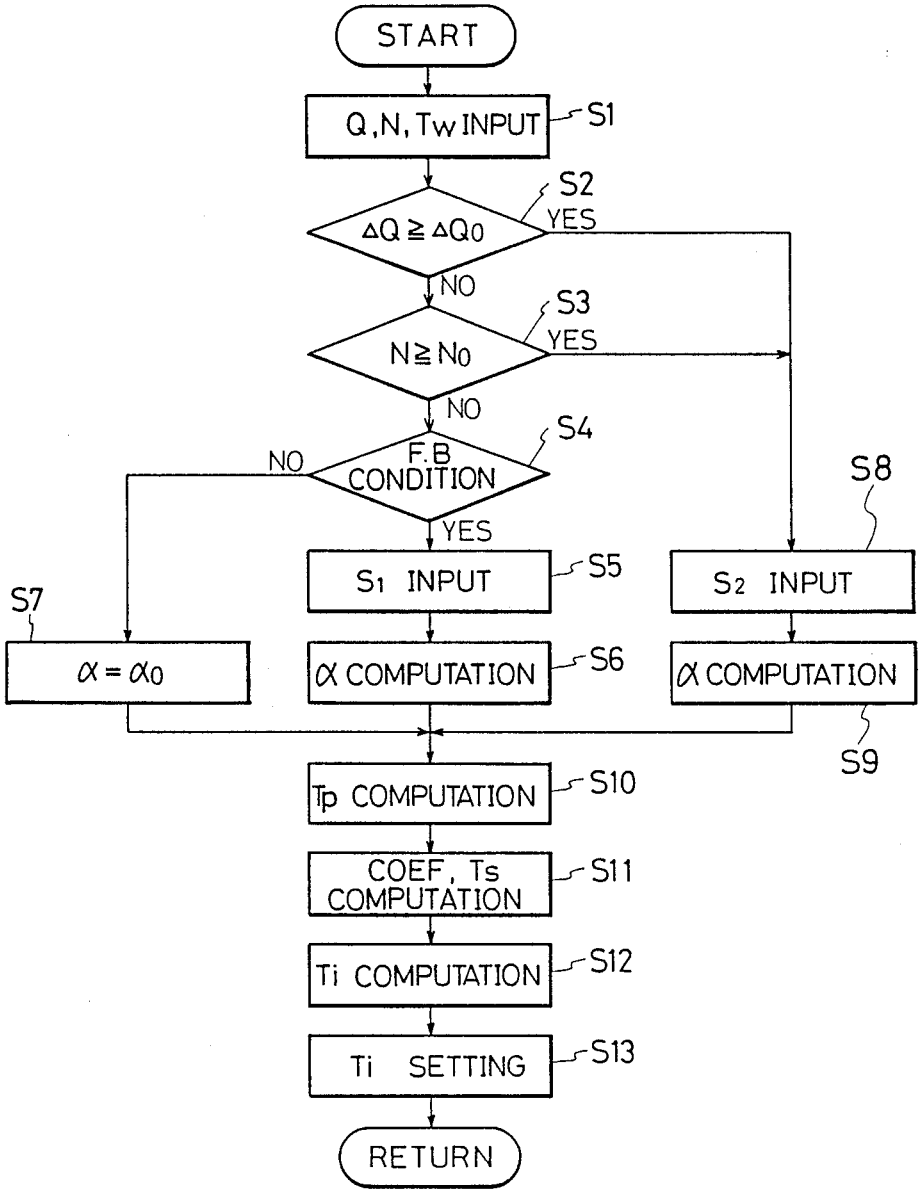
FIG. 6 is a flow chart showing the routine of calculation of the fuel injection quantity in the above-mentioned example.

The routine of computing the fuel injection quantity by the control unit will now be described with reference to the flow chart shown in FIG. 6.

At step 1, the intake air flow quantity Q detected by the air flow meter 3, the engine rotation number N detected by the crank angle sensor 11 and the cooling water temperature Tw detected by the water temperature sensor Tw are put in.

At step 2, whether or not the driving state is an accelerating state exceeding a certain level where reduction of $NO_x$ is required is judged based on whether the change ratio (the quantity of the change per unit time) $\Delta Q$ of the intake air flow quantity Q exceeds a set value $\Delta Qo$.

When it is judged at step 2 that the driving state is not the accelerating step, the routine goes to step 3, and it is judged whether or not the engine rotation number N is a high-speed rotation number exceeding a predetermined value No where reduction of $NO_x$ is required.

When it is judged at step 3 that the rotation number is not the high-speed rotation number, the routine goes to step 4, and it is judged whether or not the driving condition is one where feedback control of the air-fuel ratio to the vicinity of the theoretical air-fuel ratio is to be conducted.

When it is judged at step 4 that the driving condition is the air-fuel ratio feedback control condition, the output S1 from the first air-fuel ratio sensor 9A is put in at step 5 and the feedback correction coefficient $\alpha$ is computed at step 6 by proportional integration or the like according to the state of the output S1.

When it is judged at step 4 that the driving condition is not the air-fuel ratio feedback control condition, the routine goes to step 7, and the feedback correction coefficient is fixed at standard value $\alpha$ o (for example, 1) to stop the feedback control.

In case of the accelerating or high-speed state where the judgment at step 2 or 3 is YES, the routine goes to step 8, and the output S2 from the second air-fuel ratio sensor 9B is put in, and at step 9, the feedback correction coefficient $\alpha$ is computed by proportional integration or the like according to the state of the output S2.

After the feedback correction coefficient $\alpha$ is thus computed at steps 6 and 9 or is fixed at step 7, the routine goes to step 10, and the basic injection quantity Tp ($=KQ/N$, K is a constant) proportional to the quantity of air sucked in the cylinder per unit rotation is computed based on the intake air flow quantity Q and engine rotation number N.

At step 11, various correction coefficients COEF are computed based on the cooling water temperature and the like, and also a correction Ts corresponding to the battery voltage is computed.

At step 12, the fuel injection quantity Ti is calculated according to the following formula:

$$Ti=Tp \cdot COEF \cdot \alpha + Ts$$

At step 13, calculated Ti is set at a register.

According to the above-mentioned routine, at a predetermined fuel injection timing of the engine rotation period, an injection signal having a pulse width of Ti is given to the fuel injection valve 5 to effect injection of the fuel.

In the above-mentioned routine, the function of steps 1 through 4 corresponds to the large $NO_x$ quantity region-detecting means, the function of the course of from step to steps 5, 6 and 10 through 13 corresponds to the first air-fuel ratio feedback control means. The function of the course of steps 8 through 13 corresponds to the second air-fuel ratio feedback control means.

If the above-mentioned air-fuel control is carried out, in the small $NO_x$ quantity region where each of the judgments at steps 2 and 3 is NO, the air-fuel ratio is controlled to the vicinity of the theoretical air-fuel ratio under predetermined driving conditions based on the first air-fuel ratio sensor 9A as in the conventional technique, and the purifying effect by the ternary catalyst 10 is maintained at a high level and good exhaust characteristics and driving performances are maintained.

In the large $NO_x$ quantity region where the judgment at step 2 or step 3 is YES, the second feedback control of the air-fuel ratio to the vicinity of the air-fuel ratio at the point of reversal of the second air-fuel ratio sensor 9B is performed based on the signal of the sensor 9B in which the output level is reversed on the side richer than the first air-fuel ratio.

Figure 7:
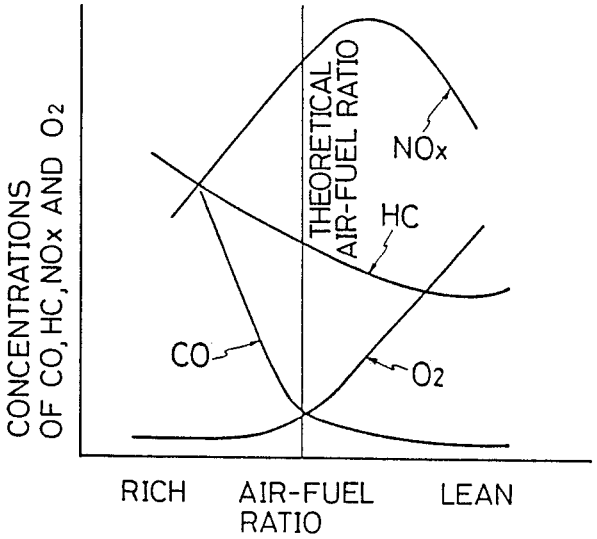
FIG. 7 is a graph illustrating the relation between the air-fuel ratio and the exhaust gas component concentrations.

As shown in FIG. 7, if the air-fuel ratio becomes richer than the first air-fuel ratio, the $NO_x$ concentration in the combustion exhaust gas tends to decrease, and the $NO_x$-purging effect by the ternary catalyst 10 is prominently increased and the air-fuel ratio is only slightly richer than the theoretical air-fuel ratio.

Accordingly, by controlling the air-fuel ratio to the rich side as described above, the content of $NO_x$ can be efficiently reduced.

Since the second air-fuel ratio sensor 9B used in this example has such characteristics that at a higher $NO_x$ concentration, the output level is reversed on a richer side, as the amount generated of $NO_x$ tends to increase, the air-fuel ratio is made richer and increase of $NO_x$ can be effectively controlled.

It has been confirmed that in the second air-fuel ratio sensor 9B, when titanium oxide or lanthanum oxide is used as the carrier of the rhodium or ruthenium catalyst layer 26, a very high effect of reducing $NO_x$ can be obtained.

Not only a sensor in which the point of reversal changes according to the $NO_x$ concentration as in the present example but also a sensor in which reversal is fixed to a specific point on the richer side can be used as the second air-fuel ratio sensor.

If the above-mentioned control system is adopted, an EGR apparatus or the like used as means for reducing $NO_x$ in the conventional technique need not be used, and the cost can be greatly reduced. Furthermore, the air-fuel ratio is made richer according to the $NO_x$ concentration without large reduction of the combustion efficiency as caused by EGR, and hence, the fuel consumption characteristic is improved.

Incidentally, in the case where combustion is performed with a lean air-fuel mixture for improving the fuel consumption characteristic, a so-called lean sensor, the output level of which is reversed on the side leaner than the theoretical air-fuel ratio, is used as the first air-fuel ratio sensor.

As is apparent from the foregoing illustration, according to the present invention, two air-fuel ratio sensors differing in the air-fuel ratio-detecting point are disposed, and in the region where the amount generated of $NO_x$ is large, the air-fuel ratio sensor detecting the air-fuel ratio on the richer side is used and the air-fuel ratio is feedback-controlled to the richer side. Because of this structure, $NO_x$ can be reduced without using an EGR apparatus or the like and the cost can be greatly reduced. Moreover, the reduction of the combustion efficiency can be prevented and the fuel consumption characteristic can be improved. Thus, various effects can be attained according to the present invention.

I claim:

1. An air-fuel ratio control apparatus for controlling the air-fuel ratio of an air-fuel mixture in an internal combustion engine, which comprises first air-fuel ratio sensing means for sensing a first level of the air-fuel ratio and outputting a reversed signal when the air-fuel ratio of the air-fuel mixture supplied to the engine is at the first level of a theoretical air-fuel ratio or leaner than the theoretical air-fuel ratio, second air-fuel ratio sensing means for sensing a second level of the air-fuel ratio and outputting a reversed signal when the second level of the air-fuel ratio of the air-fuel mixture is richer than the first air-fuel ratio, large nitrogen oxide discharge quantity region-detecting means for detecting the driving region where the quantity of nitrogen oxide discharged from the engine is larger than a set amount, first air-fuel ratio feedback control means for performing feedback control of the air-fuel ratio in the vicinity of the first level of the air-fuel ratio, where the output level of the first air-fuel ratio sensing means is reversed, based on a signal from said first air-fuel ratio sensing means when the engine is in at least a part of a region other than the driving region of the large nitrogen oxide discharge quantity detected by said detecting means, and second air-fuel ratio feedback control means for performing feedback control of the air-fuel ratio, where the output level of the air-fuel ratio sensing means is reversed, based on a signal from said second air-fuel ratio sensing means when the engine is in the driving region of the large nitrogen oxide discharge quantity detected by said large nitrogen oxide discharge quantity region-detecting means.

2. An air-fuel ratio control apparatus as set forth in claim 1, wherein said first air-fuel ratio sensing means comprises a ceramic tube having a top end closed for generating an electromotive force between an inner surface contacted with atmospheric air and an outer surface contacted with an exhaust gas emitted from the engine according to the ratio of the concentration of oxygen gas $O_2$ between said two gases, a pair of electrode members formed at parts of said inner and outer surfaces, respectively, of said ceramic tube, to take out said electromotive force as a detection signal, a platinum catalyst layer arranged to cover outer surfaces of said ceramic tube and said electrode members thereon and promote oxidation reaction of unburnt components.

3. An air-fuel ratio control apparatus as set forth in claim 2, wherein said ceramic tube is mainly composed of zirconium oxide ($ZrO_2$).

4. An air- ratio control apparatus as set forth in claim 2, wherein said first air-fuel ratio sensing means further comprises a metal oxide layer on said platinum catalyst layer to form a protecting layer.

5. An air-fuel ratio control apparatus as set forth in claim 4, wherein said metal oxide layer is the protecting layer for protecting said platinum catalyst layer and is magnesium spinel flame-sprayed on said platinum catalyst layer.

6. An air-fuel ratio control apparatus as set forth in claim 1, wherein said second air-fuel ratio sensing means comprises a ceramic tube having top end closed for generating an electromotive force between an inner surface contacted with atmospheric air and an outer surface contacted with an exhaust gas emitted from the engine according to the ratio of the concentration of oxygen gas $O_2$ between said two gases, a pair of electrode members formed at parts of said inner and outer surfaces respectively, of said ceramic tube, to take out said electromotive force as a detection signal, a platinum catalyst layer arranged to cover outer surfaces of said ceramic tube and said electrode member thereon and promote oxidation reaction of unburnt components, a reducing catalyst layer for nitrogen oxide $NO_x$ arranged to cover the outer surface of said platinum catalyst layer, and a metal oxide layer on said catalyst layer to act as a protecting layer.

7. An air-fuel ratio control apparatus as set forth in claim 6, wherein said reducing catalyst layer contains a material selected from the group of rhodium (Rh) or ruthenium (Ru).

8. An air-fuel ratio control apparatus as set forth in claim 6, wherein said reducing catalyst layer comprises a material selected from the group of rhodium or ruthenium carried on a carrier selected from the group of titanium oxide or lanthanum oxide.

9. An air-fuel ratio control apparatus as set forth in claim 1, wherein said large $NO_x$ discharge quantity region detecting means comprises means for detecting the engine driving region in an accelerating state exceeding a certain level.

10. An air-fuel ratio control apparatus as set forth in claim 1, wherein said large $NO_x$ discharge quantity region detecting means comprises means for detecting the engine rotation number N exceeding a predetermined high-speed level.

11. An air-fuel ratio control apparatus as set forth in claim 1, further comprising an exhaust passage and a catalyst converter, wherein said first and second air-fuel ratio sensing means are both located in the exhaust passage upstream from the catalyst converter.

* * * * *